US006374567B1

(12) United States Patent
Mullet

(10) Patent No.: US 6,374,567 B1
(45) Date of Patent: Apr. 23, 2002

(54) COMBINATION STOP AND SEAL MEMBER FOR DOORS

(75) Inventor: Willis J. Mullet, Pensacola Beach, FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 96 days.

(21) Appl. No.: 09/141,069

(22) Filed: Aug. 27, 1998

(51) Int. Cl.[7] ..... E04C 2/20

(52) U.S. Cl. ..... 52/716.1; 52/717.01; 52/717.03; 49/496.1; 160/40; 160/201

(58) Field of Search ..... 52/716.1, 717.01, 52/717.03; 49/496.1; 160/40, 43, 201

(56) References Cited

U.S. PATENT DOCUMENTS

| | | | | | |
|---|---|---|---|---|---|
| 3,184,808 | A | * | 5/1965 | Lyon | 160/40 |
| 3,411,981 | A | | 11/1968 | Thomas | |
| 3,656,260 | A | | 4/1972 | Weaver et al. | |
| 4,381,273 | A | | 4/1983 | Azzola | |
| 4,447,988 | A | * | 5/1984 | Cole et al. | 49/485 |
| 4,462,778 | A | | 7/1984 | Calcagni | |
| 4,472,469 | A | * | 9/1984 | Thies | 428/122 |
| 4,581,807 | A | | 4/1986 | Adell | |
| 4,690,862 | A | | 9/1987 | Hoffman | |
| 4,957,301 | A | * | 9/1990 | Clay | 277/12 |
| 5,259,143 | A | | 11/1993 | Mitchell et al. | |
| 5,260,529 | A | | 11/1993 | Miller | |
| 5,435,104 | A | * | 7/1995 | Dietrich | 49/493.1 |
| 5,784,834 | A | * | 7/1998 | Stutzman | 49/475.1 |
| 5,970,659 | A | * | 10/1999 | Oord | 49/377 |
| 6,173,533 | B1 | * | 1/2001 | Cittadini et al. | 49/478.1 |

FOREIGN PATENT DOCUMENTS

| | | |
|---|---|---|
| GB | 1 545 511 | 5/1976 |
| NL | 72-11692 | 8/1972 |

* cited by examiner

*Primary Examiner*—Carl D. Friedman
*Assistant Examiner*—Phi Dieu Tran A
(74) *Attorney, Agent, or Firm*—Renner, Kenner, Greive, Bobak, Taylor & Weber

(57) ABSTRACT

A combination stop and seal member (10) for a door (12) operatively movable between an open position and a closed position in relation to a door frame (13) including, a base (60) for attaching the member to the door frame, a projecting arm (70) extending from the base toward the door in angular relation thereto, a stop block (73) at a distal end (72) of the projecting arm for engaging the door when the door is in the closed position, and a flexible member (75) extending from the projecting arm at a location adjacent to the stop block to sealingly engage the door when the door is in the closed position.

23 Claims, 2 Drawing Sheets

COMBINATION STOP AND SEAL MEMBER FOR DOORS

TECHNICAL FIELD

The present invention relates generally to a combination stop and seal member for doors. More particularly, the present invention relates to a combination stop and seal member that operates to position and provide a weather seal for a garage door or the like. More specifically, the present invention relates to a combination stop and seal member that may be attached to the frame of a sectional overhead door or the like to laterally position the door in the closed position and provide a weather seal between the door and the frame.

BACKGROUND ART

The interrelation between a sectional garage door and the requisite door frame on the building is a matter that has received some attention over the years. As a basic parameter, sectional doors are normally of approximately the same outside dimensions as the two vertical frame members and the one horizontal frame member define the door opening. Since there is a lack of significant overlap between the door and the frame and since the door must be mounted to assure free vertical movement between the closed position and the open position, a significant gap or opening is intentionally provided between the door in the closed position and the frame members, which must be sufficient to accommodate variations in the frame members and their location and in the panels of the doors themselves.

In modern day sectional door installations, it is desirable that the gap between the door and the surrounding frame be controlled in two respects. First, a door stop is required to control the extent of the gap, such that the door is restrained from outward movement when in the closed position. The use of such a door stop, coupled with the engagement of the rollers with the roller tracks, laterally restrains the sectional door when it is in the closed position to prevent lateral movement and attendant rattling when the door is subjected to internal or external pressure variations, such as those caused by variable wind-loading. Second, a weather seal is desirable to seal the gap between the door frame of the building and the ends and top of the door when the door is in the closed position. Employing such a weather seal is particularly significant in colder climates for insulation purposes. A weather seal to prevent airflow around a door is of some significance in temperature control even in warmer climates and also serves the purpose of preventing dirt and debris from entering the building in the area around the periphery of a sectional door.

In the past, door stops have been made of wood, plastics, and other rigid and semi-rigid materials or combinations thereof. Door stops are normally positioned to tightly engage the door in the fully closed position and move progressively into engagement slightly before reaching the closed position and progressively out of engagement during the initial movement from the closed to the open position. Depending upon the materials employed, the rubbing action between a door stop and the door may erode the door stop and/or leave marks or indentations on the outer surface of the door. In addition, some door stop materials may swell or expand due to environmental conditions and/or aging and may eventually cause jamming or binding of the door during operation to the detriment of both the door stop and the door surface. Some door constructions employ metal end stiles, which, in some instances, have a return leg that extends commonly one-half to three-quarters of an inch onto the face of the door from the door edge, which is the area of the door face that contacts the door stop. Thus, the metal end stile protrudes from the face of the door at least the thickness of the material employed and can have burrs or other irregularities, particularly at the edges of the end stile. These burrs or edges can present sharp surfaces that may damage the door stop if areas are engaged too tightly against the door or if the door stop expands or swells. A further source of problems in employing door stops is that the sections of a sectional door may displace slightly outwardly in traversing the transitional radius of the roller tracks between the vertical and the horizontal positions, thereby causing the end stile to gouge or otherwise damage the door stop in that area.

Weather seals are made from a wide variety of flexible materials and are, in many instances, simply a flap attached in some manner to or proximate the door stop and extending toward and into contact with the outer surface of the sectional door when the door approaches or is in the closed position. Problems frequently encountered with weather seals are that the flexible material will sometimes catch on an end stile or other defect on a sectional door and pull the weather seal off its mounting, which may result in the weather seal being deflected and subsequently jammed between the door stop and the door. In some instances, weather seals are designed to snap onto the door stop or be retained in a groove formed in the door stop. The formation of such lips or grooves in a door stop to retain a door seal are normally costly because of close tolerances required to properly retain the weather seal. Further, even minimal damage to the lip or groove of the door stop results in the weather seal no longer being properly retained or not being appropriately positioned, such as to lose effectiveness as a weather seal element.

More recently, designs have been introduced for combination door stop and weather seal members using manufacturing methods that integrate the rigid and flexible materials together to produce an integral component. In some instances, these combined door stop and weather seal members have employed the weather seal as both the door stop member and the weather seal member. Such designs have not, however, proven to be satisfactory, in that the flexible members employed to position the door tend to wear or erode much more quickly than a rigid member, such that it loses its sealing ability in a relatively short time period. In addition, in operating as a stop, the flexible seal tends to take a set or permanent deflection over a period of time, such that it no longer is operative to satisfactorily function as a stop in positioning a door.

In other instances, the combination door stop and weather seal members employ a portion to act as the door stop and a projecting flexible material that operates as the weather seal. When a flexible weather seal is displaced outwardly of the stop surface, a longer extent of flexible material is required, which facilitates sealing irregularities between a door and the frame; however, such a flexible seal is more susceptible to damage. Such damage can take place in the operation of the door or during shipping. In particular, a rigid stop material can be slightly deformed without permanent disfigurement; however, the more flexible seal members, particularly when configured of longer lengths, can more easily be permanently deformed, such as to provide, at best, intermittent rather than continuous sealing characteristics around the periphery of a door.

Another consideration with door stops and weather seals and combination units is that the materials are subject to linear expansion and contraction with temperature changes. This expansion and contraction is a function of the mass of the cross section of the component parts. Thus, the larger the cross section of a member, the greater will be the expansion or contraction with changes in temperatures. Such expansion and contraction can affect the fit with the door frame and the door and can cause the components to sag and buckle, particularly in the instance of the flexible seal. Further, flexible sealing members with greater cross sections have more of a tendency to sag during installation, making them more difficult to install properly and necessitate more fasteners to achieve more precise positioning throughout the length of the seals, if a long-lasting, effective seal is to be achieved. While various prior-art door stop and weather seal constructions have addressed various of the issues hereinabove referenced, all have experienced some deficiencies, such that no single device has achieved a position of superiority in the industry.

DISCLOSURE OF THE INVENTION

Therefore, an object of the present invention is to provide a combination door stop and weather seal that provides for low-friction door stop operation and an efficient, flexible seal in an integral structure. Another object of the present invention is to provide such a combination door stop and weather seal wherein both the door stop element and the flexible seal are angled inwardly of the ends of the sections of the sectional overhead door, such that both elements contact the surface of the door inwardly of an end stile on the door so as to preclude engagement therewith. Still another object of the present invention is to provide such a combined door stop and weather seal that is capable of achieving efficient operation over a relatively long life.

Another object of the present invention is to provide a combined door stop and weather seal wherein an effective seal can be achieved while using a shorter flexible seal element due to its angularity and positioning in relation to the outer surface of a sectional door. Yet another object of the present invention is to provide such a combination door stop and weather seal wherein a substantial portion of the gap between the door frame and the door is bridged by a rigid member to thereby permit utilization of a shorter flexible seal. Still another object of the invention is to provide such a combination door stop and weather seal that is capable of nesting for reducing the size of shipping packages and that can be stacked, bundled, packaged, and shipped without deformation or damage to the flexible seal in normal handling conditions.

Yet another object of the present invention is to provide a combination door stop and weather seal that provides an effective seal while employing substantially less material than most prior-art devices. A further object of the present invention is to provide such a combination door stop and seal that is manufactured without the use of cellular materials, which require slower production rates and raise more complex quality-control issues. Yet a further object of the present invention is to provide such a combination door stop and weather seal that has reduced expansion and contraction when exposed to the elements due to the elimination of areas of significant cross-sectional thickness or mass. Still a further object of the present invention is to provide such a door stop and weather seal that is adaptable to gaps of differing locations and extents, with a single size and geometric configuration. Yet another object of the present invention is to provide such a combination door stop and weather seal that is cost-competitive with existing devices employed in the industry and that facilitates both easy installation due to lighter weight and precise positioning due to the stop element positively engaging the door.

In general, the present invention contemplates a combination stop and seal member for a door operatively movable between an open position and a closed position in relation to a door frame including, a base for attaching the member to the door frame, a projecting arm extending from the base toward the door in angular relation thereto, a stop block at a distal end of the projecting arm for engaging the door when the door is in the closed position, and a flexible member extending from the projecting arm at a location adjacent to the stop block to sealingly engage the door when the door is in the closed position.

PREFERRED EMBODIMENT FOR CARRYING OUT THE INVENTION

Figure 1:
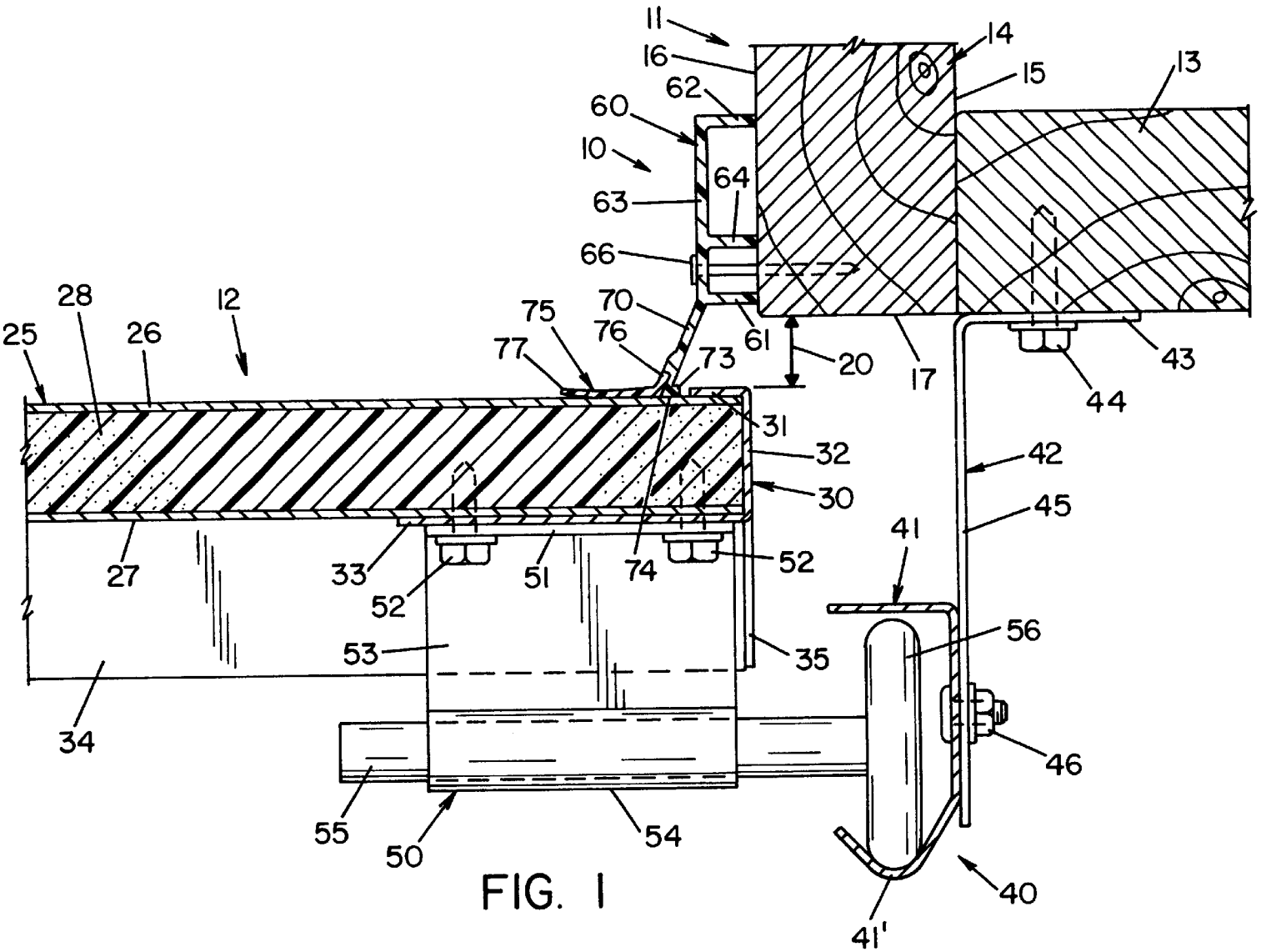
FIG. 1 is an exemplary fragmentary sectional view showing a combination stop and seal member according to the concepts of the present invention mounted on a vertical frame portion of a door opening in operative relation to a conventional sectional overhead door that moves between the vertical closed position depicted and a horizontal open position.

A combination stop and seal member according to the concepts of the present invention is generally indicated by the numeral 10 in the drawings. The combination stop and seal member 10 is depicted in juxtaposition between a portion of a building, generally indicated by the numeral 11, and a door, generally indicated by the numeral 12. In the embodiment depicted in FIG. 1 of the drawings, the door 12 is a conventional overhead garage door, with the building 11 constituting a portion of a garage for a residential structure.

The building 11 has suitable frame members 13 in the form of two vertical and one horizontal member, which define a rectangular opening in the garage, with the bottom boundary being defined by the garage floor or an extension thereof (not shown). Lying inwardly of frame members 13 is a jamb 14 that is attached to frame member 13 at an outer surface 15. The jamb 14 also has an inner surface 16 that defines the periphery of the door opening in building 11. The jamb 14 also has a laterally inwardly-directed door facing surface 17 that is substantially vertically oriented. The frame member 13 and jamb 14 are commonly constructed of wood to facilitate their inter-attachment and the attachment of door supporting and operating components thereto.

The door 12 is disposed a distance laterally inwardly of the door facing surface 17 of jamb 14 to form a space or gap 20 between the door 12 and the jamb 14. The gap 20 provides an offset to allow for dimensional variations in frame member 13, jamb 14, and the door 12, as well as surface irregularities therein.

The exemplary door 12 depicted in FIG. 1 has a plurality of vertically-connected panels for articulation between the vertical position depicted in FIG. 1 and a horizontal overhead position. The exemplary panel or section, generally indicated by the numeral 25, of door 12 consists of an outer skin 26 and a spaced, substantially parallel inner skin 27. Interposed between the outer skin 26 and the inner skin 27 is an insulating material 28. In conventional fashion, the insulating material 28 may be any of a variety of known plastic materials composed of pieces that are cut and glued in place or that may be foamed in-situ and, thus, bonded to the skins 26, 27. Exemplary materials employed for such insulation and sound-deadening purposes include polyurethane and polystyrene. As shown, the door section 25 has an end stile or cap 30 that defines the longitudinal extremity or end boundary of the door 12. The end cap 30 has an outer plate 31 overlying a portion of the outer skin 26, a connecting plate 32, and an inner plate 33 that overlies an extent of the inner skin 27 of the door section 25.

As may be appreciated from FIG. 1, the outer skin 26 of door section 25 defines a vertical plane with door 12 in the closed position that is substantially parallel to the plane defined by the inwardly-directed door facing surface 17 of the jamb 14. These two parallel vertical planes are separated by a distance constituting the gap 20 between the door 12 and the building 11. Since the door openings defined by jambs 14 of a building 11 are sized to approximately the width of a door 12, it is to be noted that the connecting plate 32 defining the end of door section 25 is substantially coplanar with the door opening defined by the inner surface 16 of the jamb 14. The door section 25 may be provided with additional conventional components, such as a projecting strut or rib 34, on the laterally inner side, which may be encompassed by the inner skin 27. The end cap 30 may have a strut extension 35 that provides an enclosure for the strut 34.

The door 12 is positioned, mounted, and movable relative to the building 11 by roller track assemblies, generally indicated by the numeral 40, positioned outwardly of the ends of the door sections 25. As shown, the roller track assemblies 40 consist of conventional J-shaped tracks 41 that are vertically positioned outwardly of each end of the door sections 25. The J-shaped tracks 41 are positioned and retained by jamb brackets 42, which may be generally L-shaped. The jamb brackets 42 have attachment legs 43 that overlie frame member 13 or jamb 14 and are affixed thereto as by screws 44 or other suitable fasteners. The jamb brackets 42 also have a support leg 45 that mounts the J-shaped tracks 41 as by a nut and bolt attachment 46, bayonet interlocks, or other suitable fasteners.

The roller track assemblies 40 interconnect the J-shaped tracks 41 with roller-mounting hinges 50, which may span adjacent door sections 25. As shown, the roller-mounting hinges 50 are attached to the inner skin 27 of door section 25 in an area outwardly of the struts 34 and where the inner plate 33 of end cap 30 overlies the inner skin 27 of door section 25. The roller-mounting hinges 50 have a leaf 51 that is attached to inner plate 33 of end cap 30 and inner skin 27 of door section 25 as by screws 52 or other suitable fasteners. The roller-mounting hinges 50 include an offset arm 53 that terminates inwardly of the door section 25 at a predetermined distance in a cylindrical sleeve 54. The cylindrical sleeve 54 freely rotatably mounts a roller shaft 55 that projects outwardly of the end cap 30 of door section 25. The roller shaft 55 mounts a guide roller 56 that is enclosed within the J-shaped track 41 for rolling engagement and guidance during movement of a door section 25.

Figure 2:
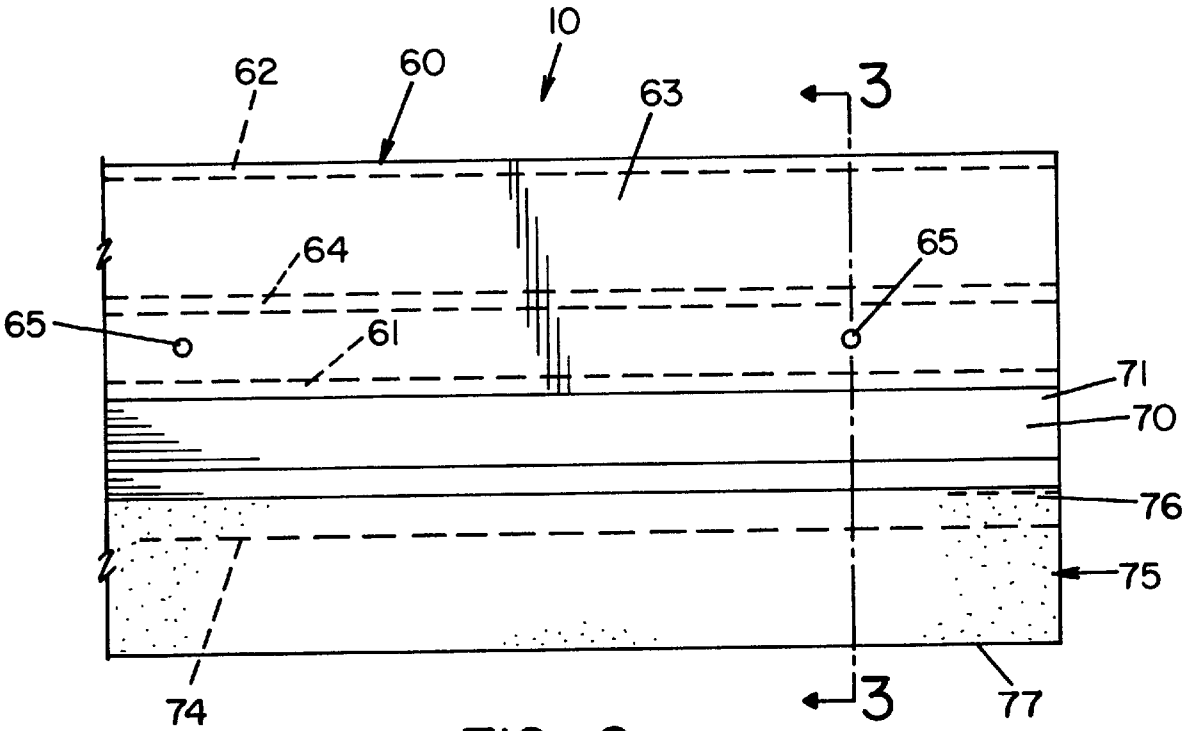
FIG. 2 is a fragmentary plan view of a length of the combination stop and seal member of FIG. 1.

The combination stop and seal member 10 includes a base 60 that is associated with and attached to the jamb 14 of building 11 in a manner to be described. As detailed in FIGS. 2 and 3, as well as in FIG. 1, the base 60 is generally rectangular and enclosed when positioned in engagement with inner surface 16 of the jamb 14. In particular, the base 60 has a laterally inner leg 61 and a laterally outer leg 62 that is spaced from and is preferably substantially parallel to laterally inner leg 61. A connecting leg 63 spaces and joins inner leg 61 and outer leg 62 and encloses the void therebetween. A rib 64 may be interposed between the inner leg 61 and outer leg 62 in parallel relation thereto. The rib 64 serves to strengthen the base 60 and is, thus, preferably of the same length as legs 61, 62, such as to engage the inner surface 16 of jamb 14.

In order to effect attachment of base 60 to inner surface 16 of jamb 14, the connecting leg 63 of base 60 may be provided with longitudinally-spaced apertures 65 for receiving nails 66 or other fasteners for attaching the base 60 to jamb 14. The apertures 65 are preferably somewhat proximate to the inner leg 61, with the rib 64 also being in proximity thereto, such that the area of the connecting leg 63 surrounding apertures 65 derive support from both the inner leg 61 and the rib 64, particularly during the insertion and seating of the nails 66.

Figure 3:
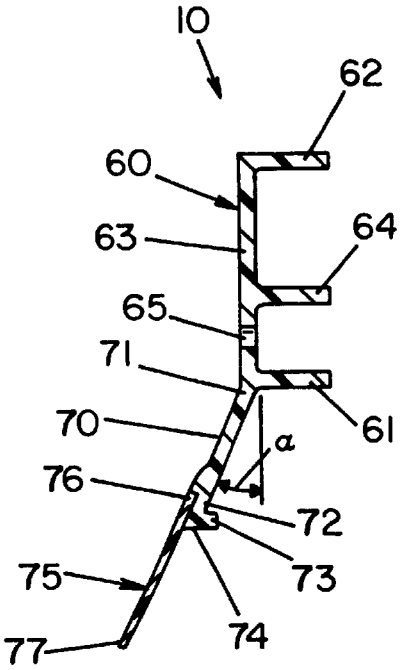
FIG. 3 is a sectional view of the combination stop and seal member of FIG. 1 taken substantially along the line 3—3 of FIG. 2.

The combination stop and seal member 10 has a projecting arm 70 extending from the base 60 laterally inwardly of the jamb 14 toward the door section 25. The projecting arm 70 is attached to the base 60, preferably at the juncture of inner leg 61 and connecting leg 63 at a proximal end 71. In this manner, a supported area of base 60 for the projecting arm 70 is provided. As best seen in FIG. 3, projecting arm 70 has at the extremity opposite the proximal end 71 a distal end 72, which may have an enlarged, cross-sectional configuration. The distal end 72 of projecting arm 70 terminates in an anvil-shaped stop block 73 that forms a door-engaging surface 74 that is preferably oriented substantially parallel to the outer skin 26 of door section 25. In addition to the fact that projecting arm 70 is offset from the jamb 14 by the thickness of the base 60, the projecting arm 70 is preferably angularly disposed relative to connecting leg 63 of base 60 through an angle a of approximately twenty-five degrees or a sufficient angle such that door-engaging surface 74 engages the outer skin 26 of door section 25 inwardly of the outer plate 31 to present a smooth, continuous surface that is not likely to damage or provide undue resistance to door-engaging surface 74 during the final stages of closing and the initial stages of opening of door 12.

Extending from the enlarged distal end 72 of projecting arm 70 is a flexible seal 75, which is preferably a ribbon-like member substantially aligned with projecting arm 70 when not in engagement with the door 12. As best seen in FIG. 3, the flexible seal 75 preferably overlaps a portion of distal end 72 of projecting arm 70 and may be inset into the surface thereof so as to provide a smoothly-contoured outer surface with the arm 70. The flexible seal 75 may be of substantially uniform cross-sectional thickness throughout its length or may taper to a slightly smaller thickness from the fixed end 76, which is attached to projecting arm 70, to the movable end 77.

While the combination stop and sealing member 10 could be constructed of various materials or combinations of materials, thermoplastic resin compositions well known in the extrusion art and available commercially are appropriate choices. One example constitutes a rigid, non-cellular polyvinyl chloride for the base 60 and projecting arm 70 and a flexible non-cellular polyvinyl chloride for the flexible seal 75. It will be appreciated that a mechanical connection between the flexible seal 75 and projecting arm 70 will not be necessary wherein compatible resins are selected that are interfusible in well-known extrusion processes that produce an integral composite profile. In addition to polyvinyl chloride, ABS or a copolymer of vinylene and vinyl acetate may be employed for one or both of the flexible and rigid components as long as resins are selected that are interfusible at extrusion temperatures to provide an integral composite profile. It is also to be recognized that cellular thermoplastic resin compositions, which are also well known in the extrusion art, could be employed to form one or both of the components of the combination door stop and seal member 10. However, because the present invention employs a minimum of material to produce the depicted configuration and that the processing of cellular thermoplastic resin compositions interject more complex processing and compounding requirements, it is normally advantageous to employ a pair of compatible non-cellular thermoplastic resin compositions of one of the types known in the extrusion arts. Thus, the combination door stop and sealing member 10 of the present invention can be inexpensively and simply produced employing known techniques in the extrusion arts to produce an integrally-formed composite profile.

Although the dimensions of the combined door stop and seal member 10 can be varied, depending upon a particular door configuration and installation parameters, it has been found that such a seal sized with the following approximate dimensions can be effectively used for most installations. The base 60 and projecting arm 70 may have a material thickness of approximately 0.08 inch, with the legs 61, 62 and rib 64 having a length of approximately 0.5 inch and connecting leg 63 having a length of approximately 1.25 inches to effect spaced seating of the legs 61, 62 on the jamb 14. A projecting arm 70 of 0.6 to 0.7 inch normally suffices to angularly span the gap 20 while maintaining inner leg 61 seated on the jamb 14. The flexible seal 75 may normally have a thickness of 0.04 or less when configured of a flexible, non-cellular PVC to achieve the desired degree of flexibility to flex to the extent depicted in FIG. 1 in the closed position of door 12, while retaining sufficient body or rigidity to maintain contact with the door 12 over a substantial portion of its length.

The installation of the door stop and seal member 10 is substantially in accordance with installation procedures extant in the door industry. If desired, the combination door stop and seal 10 may be loosely installed on the vertical jamb 14 to assist in arranging and interconnecting the door sections 25. Once fully assembled, the sectional door 12 is placed in the closed position. The combination door stop and sealing member 10 is then positioned, as depicted in FIG. 1, along each of the sides and top of the door 12. Specifically, the base 60 is positioned, and the nails 66 are inserted with the stop block 73 and particularly the door-engaging surface 74 thereof in engagement with the outer skin 26 of the door sections 25 when the door 12 is displaced inwardly so that the guide roller 56 engages the inner curvilinear surface 41' of the J-shaped tracks 41. In this manner, the guide rollers 56 are positively restrained against lateral movement until the door sections 25 depart a distance from the closed position where the tracks 41 are spaced a greater distance from the jamb 14, such that the door 12 may move out of engagement with door-engaging surface 74 of the projecting arm 70. Thus, the present invention provides both a rigid stop in the form of door-engaging surface 74 of projecting arm 70 in the closed position of the door 12, with attendant sealing effected by the flexible seal 75.

Thus, it should be evident that the combination stop and seal member for doors disclosed herein carries out one or more of the objects of the present invention set forth above and otherwise constitutes an advantageous contribution to the art. As will be apparent to persons skilled in the art, modifications can be made to the preferred embodiments disclosed herein without departing from the spirit of the invention, the scope of the invention herein being limited solely by the scope of the attached claims.

I claim:

1. A combination stop and seal member for a door operatively movable between an open position and a closed position in relation to a door frame comprising, a base for attaching the member to the door frame, a rigid projecting arm extending from said base in an angular relation thereto, a stop block at a distal end of said projecting arm adapted to engage the door when the door is in the closed position, and a flexible member extending from said projecting arm at a location adjacent to said stop block and adapted to sealingly engage the door when the door is in the closed position.

2. A combination stop and seal member according to claim 1, wherein said flexible member is adapted to be substantially aligned with said projecting arm when the door is in the open position.

3. A combination stop and seal member according to claim 1, wherein said flexible member flexes to an extent that it is adapted to be substantially aligned with the door when the door is in the closed position.

4. A combination stop and seal member according to claim 3, wherein said flexible member flexes to an extent that it is adapted to engage the door with substantially the entire length extending from said projecting arm.

5. A combination stop and seal member according to claim 3, wherein said stop block is generally anvil shaped and has a door-engaging surfacer that is adapted to be substantially coplanar with the door when the door is in the closed position.

6. A combination stop and seal member according to claim 1, wherein said flexible member overlaps and is fused to a portion of said distal end of said projecting arm.

7. A combination stop and seal member for a door operatively movable between an open position and a closed position in relation to a door frame comprising, a base for attaching the member to the door frame, a rigid projecting arm extending from said base in an angular relation thereto, a stop block at a distal end of said projecting arm adapted to engage the door when the door is in the closed position, and a flexible member extending from said projecting arm at a location adjacent to said stop block and adapted to sealingly engage the door when the door is in the closed position, said flexible member being inset into a portion of the distal end of said projecting arm.

8. A combination stop and seal member according to claim 1, wherein said projecting arm is angularly offset from said base at an acute angle.

9. A combination stop and seal member for a door operatively movable between an open position and a closed position in relation to a door frame comprising, a base for attaching the member to the door frame, a rigid projecting arm extending from said base in an angular relation thereto, a stop block at a distal end of said projecting arm adapted to engage the door when the door is in the closed position, and a flexible member extending from said projecting arm at a location adjacent to said stop block and adapted to sealingly engage the door when the door is in the closed position, said projecting arm being angularly offset from said base at an acute angle of approximately twenty-five degrees.

10. A combination stop and seal member according to claim 1, wherein said base and said projecting arm are constructed of a rigid resin and said flexible member is constructed of a flexible resin fused to said rigid resin of said projecting arm.

11. A combination stop and seal member according to claim 1, wherein said base is substantially rectangular and a proximal end of said projecting arm is attached to said base proximate a corner thereof.

12. A combination stop and seal member for a door operatively movable between an open position and a closed position in relation to a door frame comprising, a base for attaching the member to the door frame, a rigid projecting arm extending from said base in an angular relation thereto, a stop block at a distal end of said projecting arm adapted to engage the door when the door is in the closed position, and a flexible member extending from said projecting arm at a location adjacent to said stop block and adapted to sealingly engage the door when the door is in the closed position, said base being generally rectangular as defined by a laterally inner leg, a laterally outer leg, and a connecting leg joining said inner leg and said outer leg, said projecting arm attached to said base proximate the joinder of said inner leg and said connecting leg.

13. A combination stop and seal member according to claim 12, wherein a rib is interposed between and parallels said inner leg and said outer leg.

14. An integral composite stop and seal member for a door operatively movable between an open position and a closed position in relation to a door frame comprising, a base for attachment to the door frame, a rigid projecting arm formed integrally with and extending from said base toward the door in angular relation thereto, a stop block at the end of said projecting arm for positioning the door when the door is in the closed position, and a flexible seal fused to and extending from said projecting arm to engage the door when the door is in the closed position to effect a weather seal between the door and the door frame.

15. An integral composite stop and seal member for a door according to claim 14, wherein said flexible seal is attached to said projecting arm proximate to said stop block.

16. A combination stop and seal member according to claim 14, wherein said flexible seal overlaps and is fused to a portion of said end of said projecting arm adjacent to said stop block.

17. An integral composite stop and seal member for a door according to claim 14, wherein said base and said projecting arm are constructed of a rigid, non-cellular resin and said flexible seal is constructed of a compatible flexible, non-cellular resin.

18. A combination stop and weather seal for a door operatively movable on tracks between an open position and a closed position in relation to a door frame comprising, a base for selective attachment to the door frame, a rigid projecting arm extending angularly from said base toward the door, a stop means carried by said projecting arm for engaging the door when the door is in the closed position, and a sealing means extending from said projecting arm at a location adjacent to said stop means to engage the door when the door is in the closed position, thereby sealing the gap between the door and the door frame.

19. A combination stop and weather seal for a door according to claim 18, wherein said sealing means is a flexible ribbon.

20. A combination stop and weather seal for a door according to claim 18, wherein said stop means is a stop block having a door-engaging surface that lies in a plane that is adapted to be substantially parallel to the door when the door is in the closed position.

21. A combination stop and seal for a door comprising, a generally rectangular base, a rigid projecting arm extending substantially linearly and angularly from said base, a stop block at the end of said arm opposite said base, and a flexible seal extending from said projecting arm at a location adjacent to said stop block, whereby said stop block and said flexible seal are adapted to simultaneously engage the door.

22. A combination stop and seal according to claim 21, wherein said flexible member overlaps and is fused to a portion of said distal end of said projecting arm.

23. A combination stop and seal for a door comprising, a generally rectangular base, a rigid projecting arm extending substantially linearly and angularly from said base, a stop block at the end of said arm opposite said base, and a flexible seal extending from said projecting arm at a location adjacent to said stop block, whereby said stop block and said flexible seal are adapted to simultaneously engage the door, said flexible member being inset into a portion of the distal end of said projecting arm.

* * * * *

UNITED STATES PATENT AND TRADEMARK OFFICE

CERTIFICATE OF CORRECTION

PATENT NO. : 6,374,567 B1
DATED : April 23, 2002
INVENTOR(S) : Willis J. Mullet

It is certified that error appears in the above-identified patent and that said Letters Patent is hereby corrected as shown below:

Column 8,
Line 26, the word "surfacer" should be -- surface --.

Signed and Sealed this

Fifth Day of October, 2004

JON W. DUDAS
*Director of the United States Patent and Trademark Office*